US010021981B1

(12) United States Patent
Zheng

(10) Patent No.: US 10,021,981 B1
(45) Date of Patent: Jul. 17, 2018

(54) MOLDED TRAY AND CHAIR GANGING DEVICE

(71) Applicant: ZHUHAI SHICHANG METALS LTD., Zhuhai (CN)

(72) Inventor: Qiao Zheng, Zhuhai (CN)

(73) Assignee: Zhuhai Shichang Metals Ltd. (CN)

( * ) Notice: Subject to any disclaimer, the term of this patent is extended or adjusted under 35 U.S.C. 154(b) by 0 days.

(21) Appl. No.: 15/436,931

(22) Filed: Feb. 20, 2017

(51) Int. Cl.
*A47C 1/12* (2006.01)
*A47C 3/04* (2006.01)
*A47C 1/124* (2006.01)

(52) U.S. Cl.
CPC ..... *A47C 1/124* (2013.01); *A47C 3/04* (2013.01)

(58) Field of Classification Search
CPC ..... A47C 1/124; A47C 3/04
USPC ..... 297/248, 257; 108/64
See application file for complete search history.

(56) References Cited

U.S. PATENT DOCUMENTS 942,085 A * 12/1909 Linder ..... A47C 1/124 297/248
1,934,396 A * 11/1933 Bales ..... A47C 1/124 24/339
2,751,969 A * 6/1956 Kruijt ..... A47C 1/124 297/248
2,952,300 A * 9/1960 Cohen ..... A47C 1/124 297/239
2,990,876 A * 7/1961 Brook ..... A47C 1/124 297/239
3,095,237 A * 6/1963 Desnoyers ..... A47C 1/124 297/248
3,133,762 A * 5/1964 Newman ..... A47C 1/124 297/239
3,328,075 A * 6/1967 Albinson ..... A47C 1/124 297/239
3,383,738 A * 5/1968 Fox ..... A47C 1/124 24/306
3,402,963 A * 9/1968 Fujioka ..... A47C 1/124 297/239
3,614,158 A * 10/1971 Mohr ..... A47C 1/124 108/64
3,703,870 A * 11/1972 Walton ..... B60P 1/00 108/51.11
3,758,155 A * 9/1973 Straits ..... A47C 1/124 297/239
4,386,804 A * 6/1983 Ware ..... A47C 1/124 108/64
4,591,289 A * 5/1986 Vickers ..... A47B 87/002 108/64

(Continued)

*Primary Examiner* — Ryan D Kwiecinski
(74) *Attorney, Agent, or Firm* — Luedeka Neely Group, PC

(57) ABSTRACT

A molded tray and ganging device for attachment to a seat of a chair and a chair containing the molded tray and ganging device. The molded tray and ganging device includes a molded structure having an top surface, a bottom surface, and first and second raised sides attached to the bottom surface. One or more ganging rod capture structures are integrally molded into the molded structure and extend upwardly from the top surface of the molded structure. A U-shaped ganging rod is slidably attached to each of the one or more ganging rod capture structures. Each U-shaped ganging rod has a ganging engagement portion that extends outwardly from one of the raised sides of the molded structure and L-shaped ends distal from the ganging engagement portion.

13 Claims, 9 Drawing Sheets

(56) References Cited

U.S. PATENT DOCUMENTS 4,978,168 A * 12/1990 Piretti ..... A47C 1/124 108/64
5,542,159 A * 8/1996 Schultz ..... A47C 1/124 24/341
5,957,530 A * 9/1999 Gutgsell ..... A47C 1/124 297/232
6,041,721 A * 3/2000 Weston ..... E05C 19/14 108/64
6,338,528 B1 * 1/2002 Lohness ..... A47C 1/124 248/200
7,111,902 B1 * 9/2006 Conner ..... A47C 1/124 297/248
7,806,474 B2 * 10/2010 Wahl ..... A47C 13/005 297/248
9,173,494 B2 * 11/2015 Fahlstedt ..... A47C 3/14
9,226,592 B2 * 1/2016 Lin ..... A47C 31/00
9,351,577 B2 * 5/2016 Rogers ..... A47C 3/04
9,713,382 B2 * 7/2017 Rogers ..... A47C 1/124
9,826,832 B2 * 11/2017 Lin ..... A47B 87/007
2005/0146179 A1 * 7/2005 Murphy ..... A47C 1/124 297/248
2005/0253430 A1 * 11/2005 George ..... A47C 1/124 297/248
2010/0176634 A1 * 7/2010 Wahl ..... A47C 13/005 297/248
2012/0313412 A1 * 12/2012 Fahlstedt ..... A47C 1/124 297/248
2014/0152059 A1 * 6/2014 Swy ..... A47C 1/124 297/188.01
2014/0175848 A1 * 6/2014 Motta ..... A47C 1/124 297/248
2014/0252824 A1 * 9/2014 Saint Pierre ..... A47C 3/04 297/239
2015/0130236 A1 * 5/2015 Rogers ..... A47C 3/04 297/239
2015/0296986 A1 * 10/2015 Rogers ..... A47C 1/124 297/239
2016/0095434 A1 * 4/2016 Lin ..... A47B 87/007 24/517

* cited by examiner

MOLDED TRAY AND CHAIR GANGING DEVICE

TECHNICAL FIELD

The disclosure relates generally to chairs. More particularly, the disclosure is directed to chair ganging device structures and to chairs containing the ganging device structures.

BACKGROUND AND SUMMARY

Chairs that can readily be attached to one another are typically used in multi-purpose rooms to provide a variety of different chair configurations and numbers of chairs in a row. Such chairs are suitably light in weight and have a configuration that enhances the ability of the chairs to be stacked on one another when not in use.

In order to improve safety and provide uniform spacing and numbers of chairs in a row, ganging systems are typically used to interlock adjacent chairs to one another. A wide variety of interlocking or ganging devices are known and are attached in a variety of ways to the chairs. Despite the variety of known ganging devices, there remains a need for a ganging device that can be produced in high volume and having a relatively simple, yet robust mechanism, for attaching the ganging device to a chair.

In view of the foregoing, embodiments of the disclosure provide a molded tray and ganging device for attachment to a seat of a chair and a chair containing the molded tray and ganging device. The molded tray and ganging device includes a molded structure having an top surface, a bottom surface, and first and second raised sides attached to the bottom surface. One or more ganging rod capture structures are integrally molded into the molded structure and extend upwardly from the top surface of the molded structure. A U-shaped ganging rod is slidably attached to each of the one or more ganging rod capture structures. Each U-shaped ganging rod has a ganging engagement portion that extends outwardly from one of the raised sides of the molded structure and L-shaped ends distal from the ganging engagement portion.

In one embodiment there is provided a chair having an integrally molded seat and backrest, a molded tray and ganging device attached to an underside of the seat, and tubular legs attached to the seat and molded tray. The molded tray and ganging device includes a molded structure having a top surface, a bottom surface, and first and second raised sides attached to the bottom surface. One or more ganging rod capture structures are integrally molded into the molded structure and extend upwardly from the top surface of the molded structure. A U-shaped ganging rod is slidably attached to each of the one or more ganging rod capture structures. Each U-shaped ganging rod has a ganging engagement portion that extends outwardly from one of the raised sides of the molded structure and L-shaped ends distal from the ganging engagement portion.

In some embodiments, each of the first and second raised sides includes U-shaped openings therein for receiving tubular legs of the chair.

In other embodiments, the one or more ganging rod capture structures include a plurality of fingers, each of the fingers having a resiliently biased prong for capturing the ganging rod therein.

In some other embodiments, the one or more ganging rod capture structures further include an upstanding guide web integrally molded into the top surface of the molded structure. Each guide web has a plurality of spaced-apart detents for positional retention of the L-shaped ends of the ganging rod.

In still other embodiments, a plurality of apertures are provided in the bottom surface of the molded structure for attaching the molded structure to the seat of the chair using fasteners.

In other embodiments, a U-shaped ganging rod having a male ganging engagement portion extends outwardly from the first raised side and a U-shaped ganging rod having a female ganging engagement portion extends outwardly from the second raised side of the molded structure.

In some embodiments one of the 1e U-shaped ganging rods is fixedly attached to the top surface of the molded structure.

An advantage of the molded structure is that the one or more ganging rods may be snap-fitted into the ganging rod capture structures and slidably retained in the structures without the need for additional rod fasteners. Also, the entire tray and tubular legs can be attached to a seat of a chair using only four fasteners.

BRIEF DESCRIPTION OF THE DRAWINGS

Additional features and advantages of the disclosed embodiments will be apparent from the detailed description which follows, taken in conjunction with the accompanying drawings, which together illustrate, by way of example, features of the disclosed embodiments; and, wherein.

Reference will now be made to the exemplary embodiments illustrated, and specific language will be used herein to describe the same. It will nevertheless be understood that no limitation of the scope of the invention is thereby intended.

DETAILED DESCRIPTION OF EXEMPLARY EMBODIMENT(S)

Figure 1:
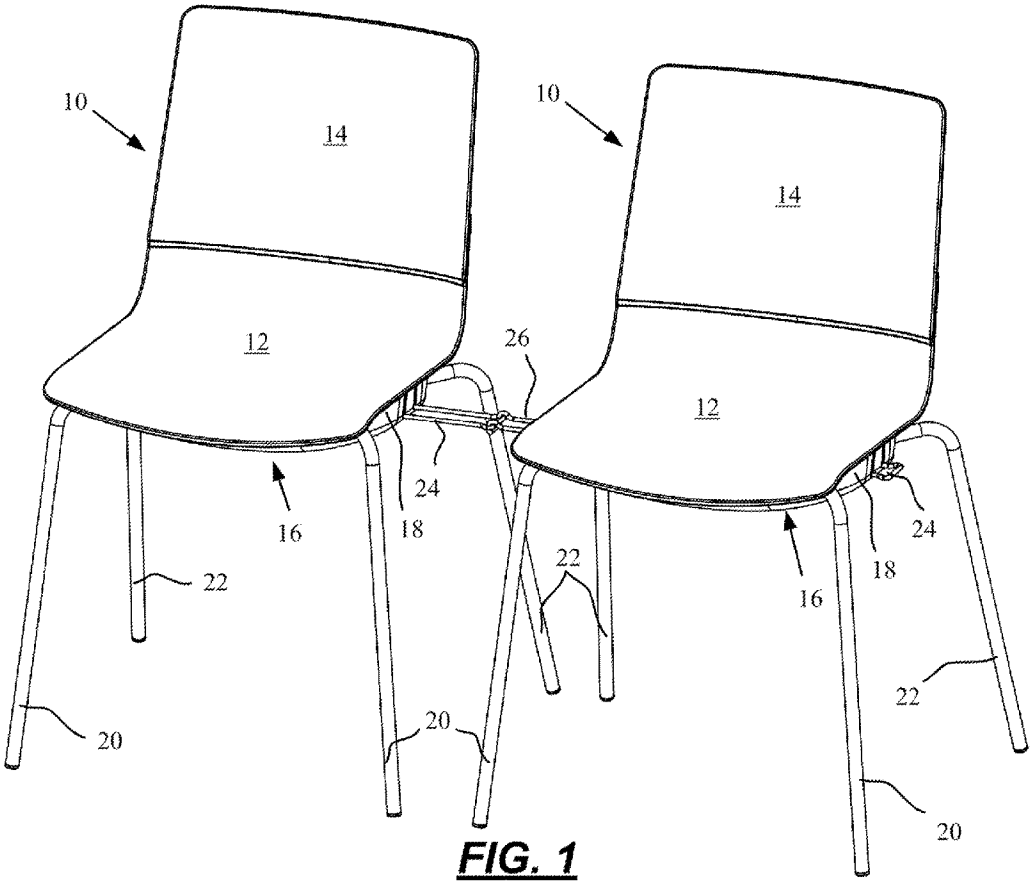
FIG. 1 is a perspective view of two chairs coupled together using a molded tray and ganging device according to an embodiment of the disclosure.

As illustrated in FIGS. 1-10, a pair of chairs 10 in accordance with an embodiment of the disclosure is illustrated. The chairs 10 may be banquet or conference style chairs that may be configured to be stacked together, one on top of another. The chairs 10 may also be arranged in side-by-side interlocking relationship as illustrated in FIGS. 1-6. FIG. 1 is a front perspective view of two interlocked chairs 10, each chair having a seat 12, a backrest 14, a molded molded tray and ganging device 16 having a molded structure 18 attached to the bottom of the seat 12, front legs 20, rear legs 22, a U-shaped ganging rod 24 having a female engagement portion on one side of the chair and a U-shaped ganging rod 26 having a male engagement portion on an opposite side of the chair 10 as shown so that the chairs 10 may be interlocked together to form a row of chairs 10. When not in use, the ganging rods 24 and 26 may be retracted into the molded structure 18. In one embodiment, one of the rods 24 or 26 may be fixed and one of the rods 24 or 26 may be slidably engaged with the molded structure 18. In another embodiment, both rods 24 and 26 are slidably engaged with the molded structure 18 as described in more detail below.

The legs 20 and 22 may be oriented substantially vertically with respect to the seat 12 and located in a generally rectangular configuration. In one embodiment, the front and rear legs 20 and 22 may have an inward incline, such as an acute angle with respect to vertical, to facilitate stacking and/or nesting of the chair 10 with another chair 10 when the chairs 10 are stored. The seat 12 of each chair 10 may be oriented substantially horizontally but can have a slight (or acute) incline with respect to horizontal for comfort. The backrest 14 may be substantially vertical yet have a slight (or acute) outward incline or angle with respect to vertical, opposite to that of the rear legs 22, for comfort thereby forming a substantially L-shaped seating arrangement with respect to the seat 12. Accordingly, the backrest 14 above the seat 12 may form an obtuse angle with respect to the seat 12 for comfort, and/or to facilitate stacking with another chair 10. The legs 20 and 22 may be made of a metal such as aluminum and may have a rectangular, square or round cross-sectional shape. As described in more detail below, the legs 20 and 22 may be attached to the seat 12 of the chair by means of the molded tray and ganging device 16.

The seat 12 and backrest 14 may be made from common, low-cost natural or synthetic materials, such as wood, plastic, polypropylene, polyethylene, nylon or equivalent polymeric materials. Each of the seat 12 and backrest 14 may be padded or unpadded. In one embodiment, the seat 12 and backrest 14 are integrally molded as one piece using a simple high-volume manufacturing technique, such as injection molding, thermoforming, or blowmolding. In another embodiment, the seat 12 and backrest 14 are separately made and attached to one another using conventional fastening techniques such as screws, bolts, adhesive, and the like.

Figure 2:
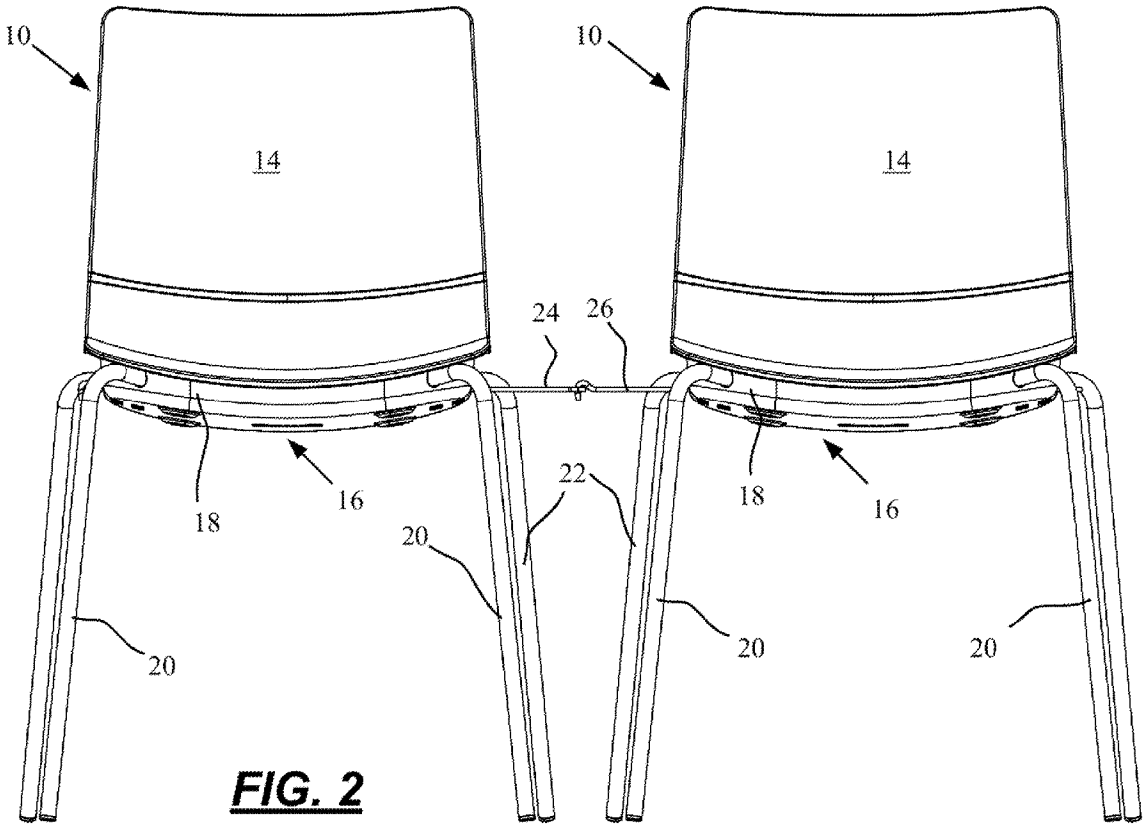
FIG. 2 is a front elevational view of the two chairs of FIG. 1.

FIG. 2 is a front elevational view of the chairs 10 with ganging rods 24 and 26 fully extended from the chairs 10 and interlocked so that the chairs 10 are spaced apart a predetermined distance.

Figure 3:
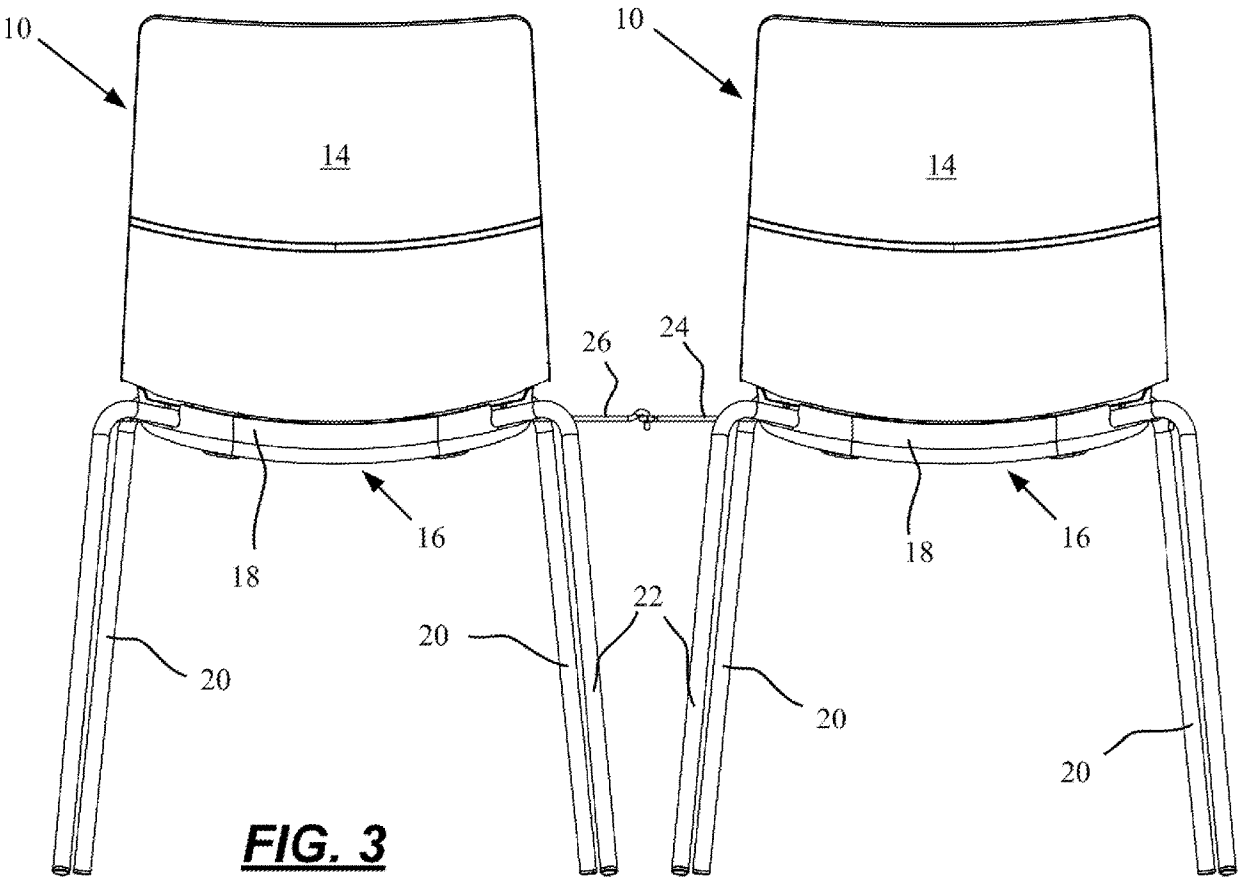
FIG. 3 is a rear elevational view of the two chairs of FIG. 1.

A rear elevational view of the chairs 10 is shown in FIG. 3. The chairs 10 are spaced apart a distance that is sufficient for comfort and to prevent interference between the legs 20 and 22 of the chairs 10.

Figure 4:
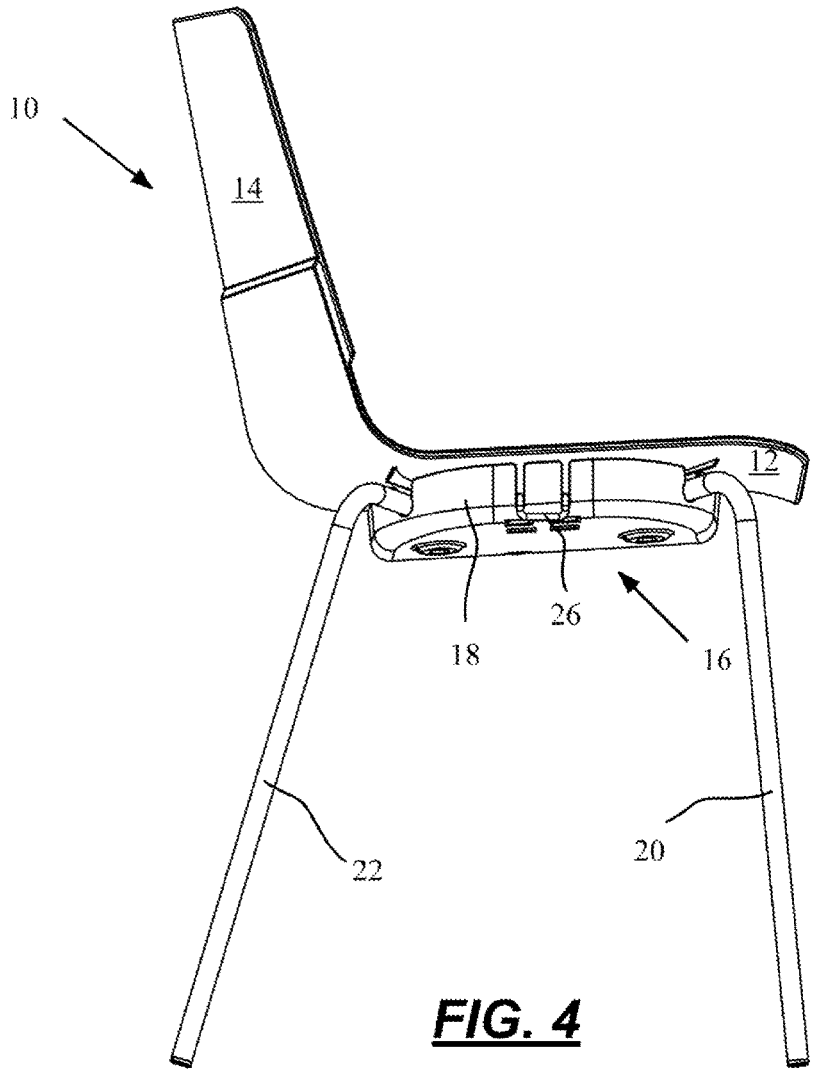
FIG. 4 is a side elevational view of one of the chairs of FIG. 1 having a molded tray and ganging device attached to the seat of the chair according to an embodiment of the disclosure.

FIG. 4 is a side elevational view of the chair 10 showing in more detail the angle of the legs 10 and 20, seat 12 and backrest 14, as well as the position of the molded tray and ganging device 16 attached to the seat 12 of the chair 10.

Figure 5:
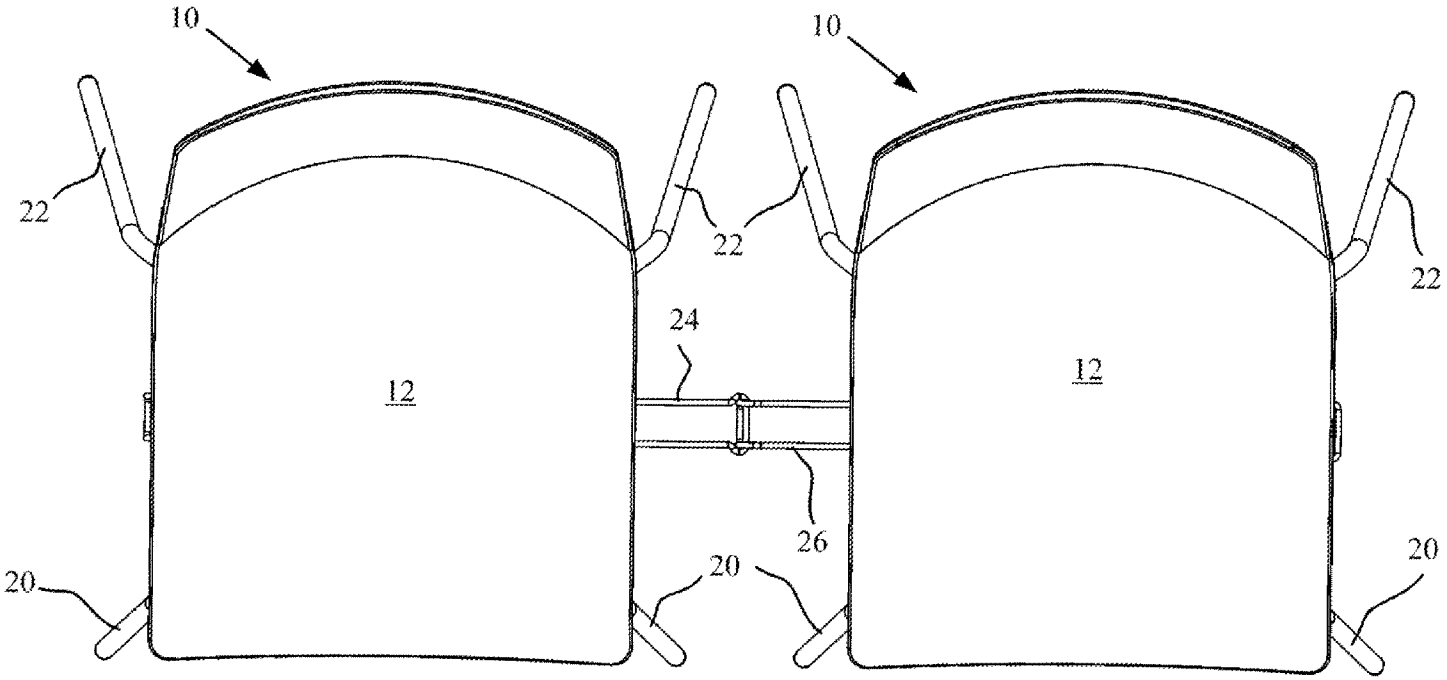
FIG. 5 is a top plan view of the two chairs of FIG. 1.
Figure 6:
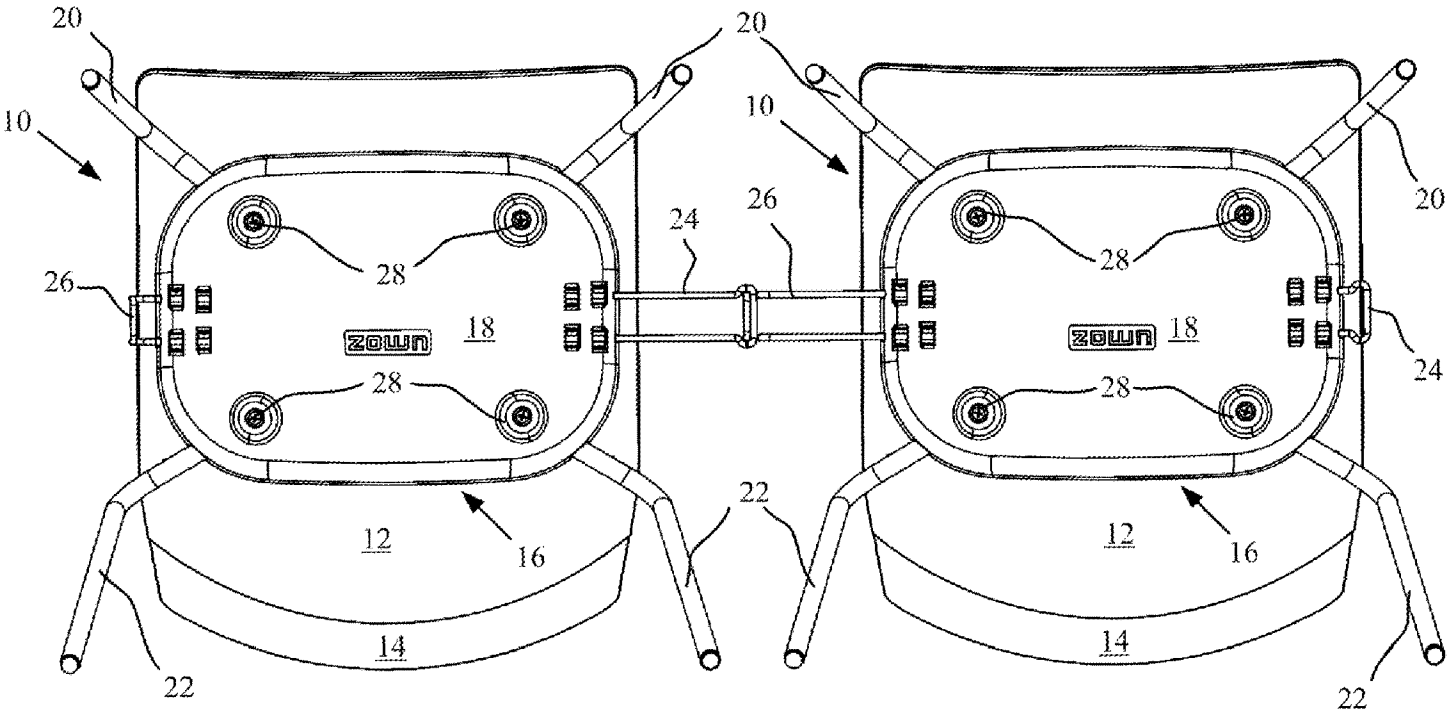
FIG. 6 is a bottom plan view of the two chairs of FIG. 1.

FIGS. 5 and 6 show top and bottom plan views of the chairs 10. In the bottom plan view of FIG. 6, four fasteners 28 are shown for attaching the molded tray and ganging device 16 and legs 20 and 22 to the seat 12 of the chair 10.

Figure 7:
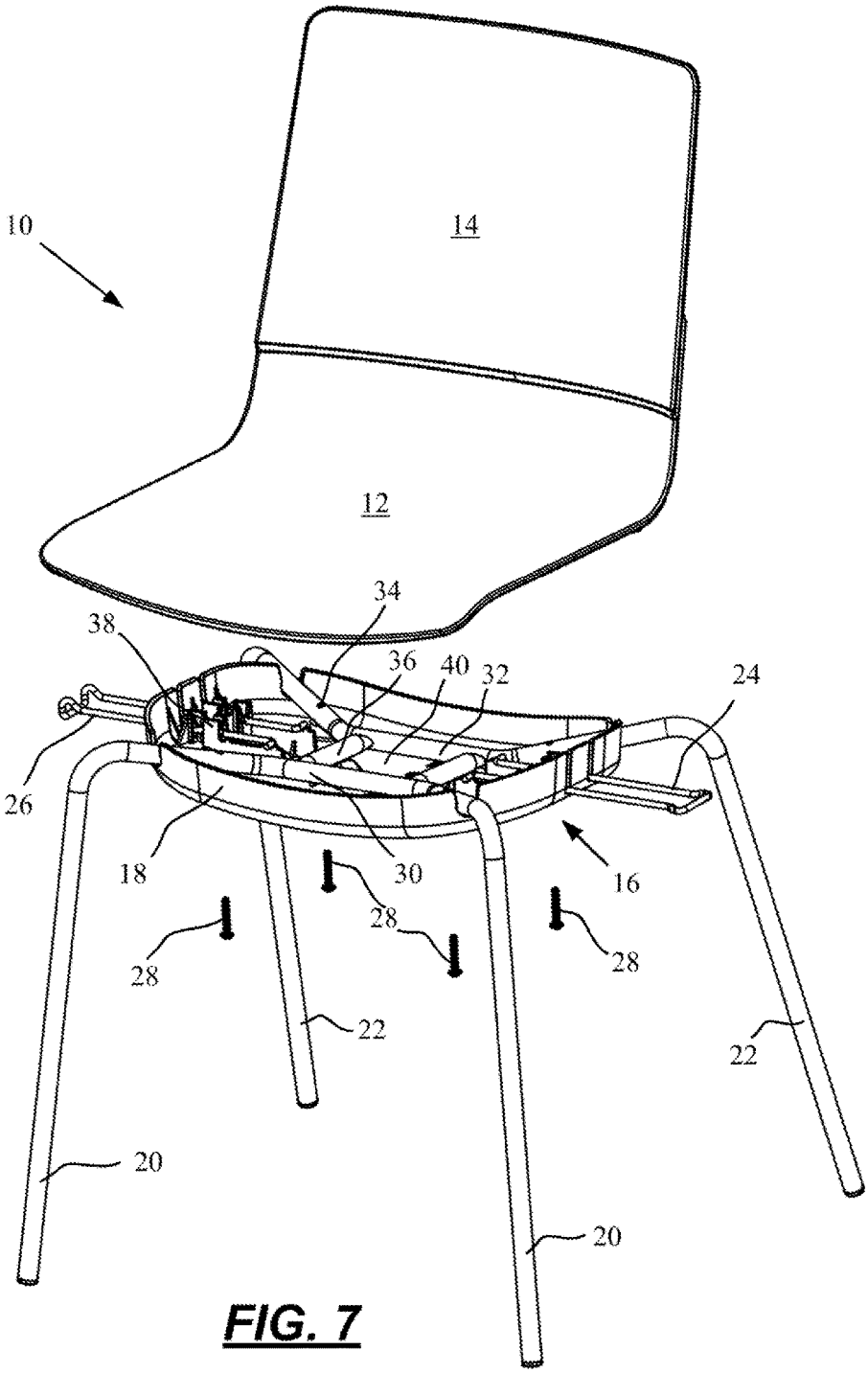
FIG. 7 is a perspective exploded view of a chair in accordance with an embodiment of the disclosure.

A perspective exploded view of the chair 10 according to an embodiment of the invention is illustrated in FIG. 7. An important aspect of the disclosure is the molded tray and ganging device 16 that includes the molded structure 18. The molded structure 18 is configured to capture the front and rear tubular legs 20 and 22 between the molded structure and the seat 12 of the chair 10. The ganging rods 24 and 26 having female and male ganging engagement portions are also engaged with the molded structure 18 on opposite sides thereof. At least one of the ganging rods 24 and 26 is slidably engaged with the molded structure 18 as discussed in more detail below. Fasteners 28, such as screws or bolts are used to fixedly attach the molded tray and ganging device 16 to the seat 12.

Each of the tubular legs 20 and 22 may have a U-shaped configuration with closed ends 30 and 32 being disposed through the molded structure 18. Aperatures 34 may be provided in each of the closed ends 30 and 32 for the fasteners 28 to pass therethrough to the underside of the seat 12 for fixedly attaching the molded structure 18 and legs 20 and 22 to the seat 12. In one embodiment, one or more reinforcing cross-members 36 may be used to attach the closed ends 30 and 32 of the legs 20 and 22 to one another and to provide additional rigidity of the tubular legs 20 and 22. In a preferred embodiment, one or more ganging rod capture structures 38 are integrally molded into the molded structure 18 and extend upwardly from the top surface 40 of the molded structure 18.

In accordance with more detailed aspect of the embodiments, at least one of the ganging rods 24 and 26 may be slidably engaged with the ganging rod capture structure 38 so that the ganging rod 24 or 26 may be extended and retracted with respect to the seat 12. As shown in more detail in FIGS. 8-9, the ganging rod 26 having a male ganging engagement portion may include a rod bent in a U-shape and having straight portions 42 slidably engaged with the ganging rod capture structure 38. The ganging rod 26 has L-shaped distal ends 44 which may be used to engage a plurality of positional detents (two detents 46 and 48 shown) provided on a guide web 50 of the ganging rod capture structure 38. As with the other components of the ganging rod capture structure 38, the guide web 50 of the preferred embodiment is integrally molded into the molded structure 18 and extends upwardly from the top surface 40 of the molded structure 18.

Figure 8:
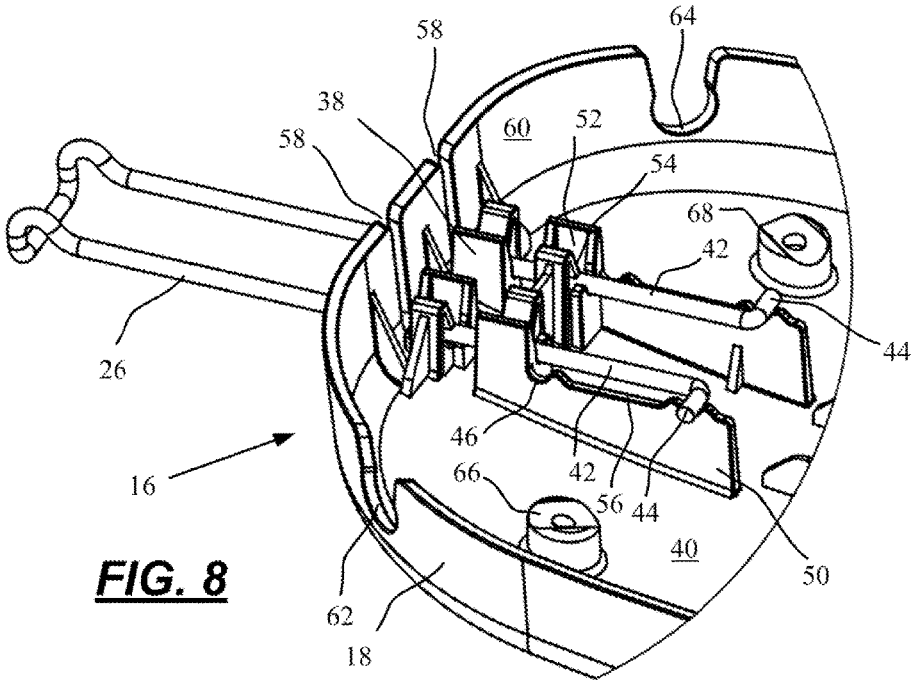
FIG. 8 is a partial perspective view of the molded structure and ganging rod in a first position according to an embodiment of the disclosure.
Figure 9:
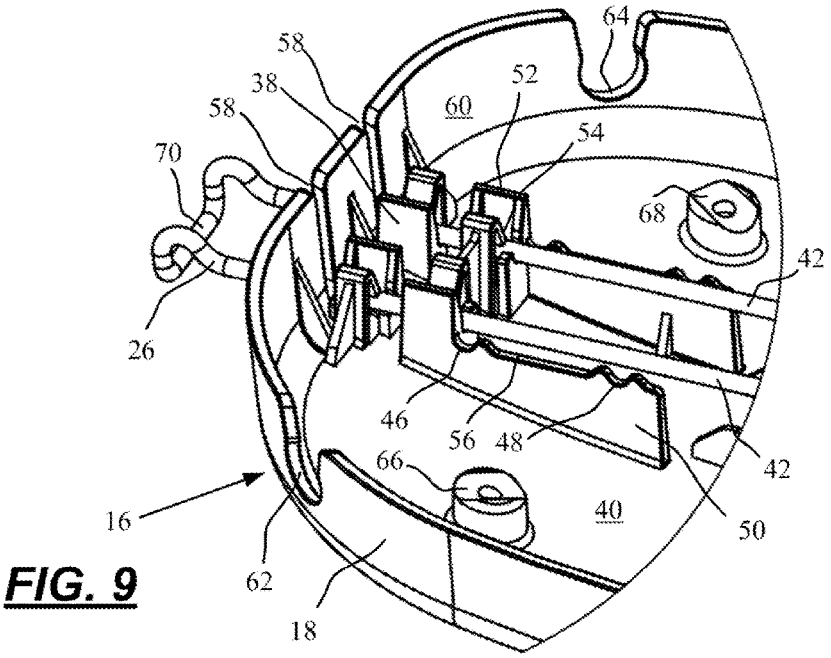
FIG. 9 is a partial perspective view of the molded structure and ganging rod in a storage position.

In FIG. 8, the ganging rod 26 is extended from the molded structure so that the L-shaped distal ends 44 are engaged with detent 48 (FIG. 9). In its fully extended position, the L-shaped distal ends 44 of rod 26 are engaged with detent 46. In a fully retracted position, as shown in FIG. 9, the L-shaped distal ends 44 extend past the web 50 and are not engaged with either detent 46 or 48.

The ganging rod capture structure 38 also includes two or more fingers 52. Each finger 52 is U-shaped and has a resiliently biased prong 54 for capturing the ganging rod therein. In one embodiment, only one side of the finger 52 includes the prong 54. In another embodiment, both sides of the finger 52 include prongs 54. Once the rod 26 is snappingly engaged with the fingers 52 and held in place vertically by the prongs 54, the rod 26 may slide horizontally through the fingers 52 along a top surface 56 of the web 50 for engaging the detents 46 and 48. The L-shaped distal ends 44 of the rod 26 engage the fingers 52 and prevent the rod 26 from disengaging from the molded tray and ganging device 16. The straight portions 42 of the rod 26 are disposed through slots 58 in a first side wall 60 of molded structure 18. In FIG. 9, the ganging rod 26 is in a storage position so that the U-shaped end 70 of the rod 26 is closely adjacent to the side wall 60. Straight portions of the rod 24 are disposed through slots in a second side wall on an opposite side of the molded structure 18 (FIG. 7).

Figure 10:
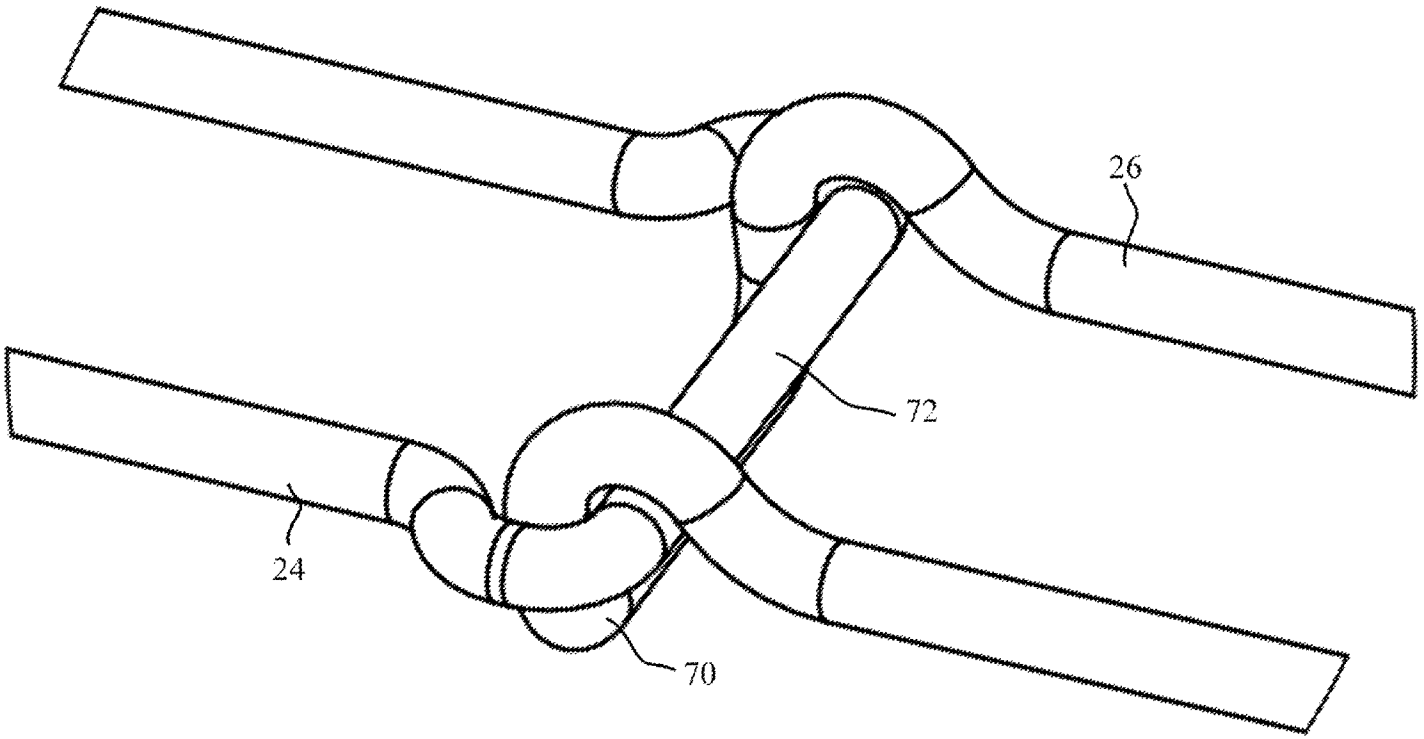
FIG. 10 is a partial perspective view of interconnected U-shaped ganging rods for use with the molded tray and ganging device according to an embodiment of the disclosure.

As shown in FIG. 10, the U-shaped end 70 of the ganging rod 26 is configured to engage and interlock with a U-shaped end 72 of the ganging rod 24 when the chairs 10 are connected to one another as shown in FIGS. 1-6. The ganging rods 24 and 26 may be made from stainless steel wire or rod or other suitable material and bent into the U-shaped ends that extend from the molded structure 18. The U-shaped end 70 of the ganging rod 26 may have a narrower width or end than the U-shaped end 72 of the ganging rod 24 to facilitate interconnection of the ganging rods 24 and 26 with one another.

Other features of the side wall 60 include U-shaped aperatures 62 and 64 for the tubular front and rear legs 20 and 22. Support columns 66 and 68 extend upwardly from the top surface 40 of the molded structure 18 and are provided to engage and provide additional support for the tubular legs 20 and 22. In a preferred embodiment, the support columns 66 and 68 are also integrally molded into the top surface 40 of the molded structure 18.

In the embodiments described above, there is a single ganging rod 24 and a single ganging rod 26 on opposite sides of the molded structure 18. However, the disclosure is not limited to having a single ganging rod on each side of the molded structure. Accordingly, two or more ganging rods may be used on each side of the molded structure 18. The two or more ganging rods on each side may be ganging rods 24 having female engagement portions, ganging rods 26 having male engagement portions or a mixture of ganging rods 24 and 26 having female and male engagement portions.

The description and illustration of one or more embodiments provided in this application are not intended to limit or restrict the scope of the invention as claimed in any way. The embodiments, examples, and details provided in this application are considered sufficient to convey possession and enable others to make and use the best mode of claimed invention. The claimed invention should not be construed as being limited to any embodiment, example, or detail provided in this application. Regardless of whether shown and described in combination or separately, the various features (both structural and methodological) are intended to be selectively included or omitted to produce an embodiment with a particular set of features. Having been provided with the description and illustration of the present application, one skilled in the art may envision variations, modifications, and alternate embodiments falling within the spirit of the broader aspects of the general inventive concept embodied in this application that do not depart from the broader scope of the claimed invention.

What is claimed is:

1. A molded tray and ganging device for attachment to a seat of a chair, the molded tray and ganging device comprising:

a molded structure having a top surface, a bottom surface, and first and second raised sides attached to the bottom surface, one or more ganging rod capture structures integrally molded into the molded structure and extending upwardly from the top surface of the molded structure, and a U-shaped ganging rod slidably attached to each of the one or more ganging rod capture structures, the U-shaped ganging rod having a ganging engagement portion that extends outwardly from one of the first and second raised sides of the molded structure and L-shaped ends distal from the ganging engagement portion.

2. The molded tray and ganging device of claim 1, wherein the first and second raised sides include U-shaped openings therein for receiving tubular legs of the chair.

3. The molded tray and ganging device of claim 1, wherein the one or more ganging rod capture structures comprise a plurality of fingers, each of the fingers having a resiliently biased prong for capturing the ganging rod therein.

4. The molded tray and ganging device of claim 3, wherein the one or more ganging rod capture structures further comprise an upstanding guide web integrally molded into the top surface of the molded structure, each guide web comprising a plurality of spaced-apart detents for positional retention of the L-shaped ends of the ganging rod.

5. The molded tray and ganging device of claim 1, further comprising a plurality of apertures in the bottom surface of the molded structure for attaching the molded structure to the seat of the chair using fasteners.

6. The molded tray and ganging device of claim 1, wherein the U-shaped ganging rod comprises a first U-shaped ganging rod having a male ganging engagement portion that extends outwardly from the first raised side and a second U-shaped ganging rod having a female ganging engagement portion that extends outwardly from the second raised side of the molded structure.

7. A chair comprising the molded tray and ganging device of claim 1.

8. A chair having an integrally molded seat and backrest, a molded tray and ganging device attached to an underside of the seat, and tubular legs attached to the seat and molded tray, the molded tray and ganging device comprising:

a molded structure having a top surface, a bottom surface, and first and second raised sides attached to the bottom surface, one or more ganging rod capture structures integrally molded into the molded structure and extending upwardly from the top surface of the molded structure, and a U-shaped ganging rod slidably attached to each of the one or more ganging rod capture structures, the U-shaped ganging rod having a ganging engagement portion that extends outwardly from one of the first and second raised sides of the molded structure and L-shaped ends distal from the ganging engagement portion.

9. The chair of claim 8, wherein the first and second raised sides include U-shaped openings therein for receiving the tubular legs of the chair.

10. The chair of claim 8, wherein the one or more ganging rod capture structures comprise a plurality of fingers, each of the fingers having a resiliently biased prong for capturing the ganging rod therein.

11. The chair of claim 10, wherein the one or more ganging rod capture structures further comprise an upstanding guide web integrally molded into the top surface of the molded structure, each guide web comprising a plurality of spaced-apart detents for positional retention of the L-shaped ends of the ganging rod.

12. The chair of claim 8, further comprising a plurality of apertures in the bottom surface of the molded structure for attaching the molded structure to the underside of the seat of the chair using fasteners.

13. The chair of claim 8, wherein the U-shaped ganging rod comprises a first U-shaped ganging rod having a male ganging engagement portion that extends outwardly from the first raised side and a second U-shaped ganging rod having a female ganging engagement portion that extends outwardly from the second raised side of the molded structure.

* * * * *